US005873409A

United States Patent [19]

Letrange et al.

[11] Patent Number: 5,873,409

[45] Date of Patent: Feb. 23, 1999

[54] HEADER PLATE FOR A HEAT EXCHANGER, ESPECIALLY FOR A MOTOR VEHICLE

[75] Inventors: Frédéric Letrange, Nanterre; Carlos Martins, Montfort L'Amoury, both of France

[73] Assignee: Valeo Thermique Moteur, Le Mesnil-Saint Denis, France

[21] Appl. No.: 820,119

[22] Filed: Mar. 19, 1997

[30] Foreign Application Priority Data

Mar. 22, 1996 [FR] France ..... 96 03636

[51] Int. Cl.[6] ..... F28F 9/04

[52] U.S. Cl. ..... 165/173; 29/890.043; 165/DIG. 492

[58] Field of Search ..... 165/767, 153, 165/173; 29/890.043, 890.052

[56] References Cited

U.S. PATENT DOCUMENTS

| | | | |
|---|---|---|---|
| 4,234,041 | 11/1980 | Melnyk | 165/173 |
| 4,582,127 | 4/1986 | Moranne | 165/83 |
| 4,881,594 | 11/1989 | Beamer et al. | 165/173 |
| 5,036,913 | 8/1991 | Murphy et al. | 165/173 |
| 5,236,336 | 8/1993 | Hitoshi | 165/153 |
| 5,299,636 | 4/1994 | Potier | 165/173 |

FOREIGN PATENT DOCUMENTS 2538526 6/1984 France .

*Primary Examiner*—Allen Flanigan
*Attorney, Agent, or Firm*—Morgan & Finnegan, L.L.P.

[57] ABSTRACT

A header plate has a central portion in which at least one row of holes are formed. The heat exchanger includes tubes which are fitted in these holes, and each hole is made in a press-formed element which comprises at least two raised elements aligned with each other. The respective dimensions of these raised elements are predetermined, and they are adapted to be pierced individually or in combination by means of perforating tools having different characteristic dimensions in at least the direction in which the raised elements are aligned with each other. Tubes of different dimensions in at least this alignment direction can be introduced into the holes.

6 Claims, 1 Drawing Sheet

HEADER PLATE FOR A HEAT EXCHANGER, ESPECIALLY FOR A MOTOR VEHICLE

FIELD OF THE INVENTION

This invention relates to header plates, or collectors, for heat exchangers, especially for motor vehicles, and the like. More particularly, the invention relates to header plates which have, in a central portion or part of the header plate, at least one row of parallel holes for receiving the ends of tubes of the heat exchanger.

BACKGROUND OF THE INVENTION

The parallel holes, the profiles of which are matched to those of the tubes which are to extend through them, are generally formed in press-formed elements or deformations by means of a piercing operation. In order to manufacture such a heat exchanger, it is necessary to start with a workpiece in the form of a pressing, which may also be referred to as a medallion. In a first step of the operation, this workpiece is press-formed using a first tool, in order to form a set of parallel press-formed elements.

A second stage of the operation is the piercing operation in which the holes are formed. One of these holes is formed in each of the press-formed elements of the workpiece. The forms and dimensions of the holes are matched to the transverse cross section of the tubes which are to be subsequently introduced into the holes. The press-forming operation of the first step in the process is only able to correspond to a single type of tube having preselected dimensions. In consequence, if it is desired to make a heat exchanger having tubes of dimensions which are substantially different from each other, it is necessary to take a fresh workpiece which is innocent of any deformations or press-formed elements, and then to form the latter by stamping with another press-forming tool, the press-formed elements being finally pierced to form the holes using another piercing tool which represents yet another tool.

Accordingly, there is therefore no standard type of header plate in existence that could be matched to the dimensions of tubes having different cross sections.

Consequently, one of the objects of the invention is to provide a header plate which does not have this drawback of the header plates in the prior art.

DISCUSSION OF THE INVENTION

According to the invention in a first aspect, a header plate for a heat exchanger, in particular for a motor vehicle, of the type comprising, in a central portion thereof, at least one row of holes adapted to receive the ends of tubes. The plate is characterised in that each hole is formed in a press-formed element which includes at least two aligned raised elements of respective selected dimensions. The raised elements are adapted to be pierced individually or in combination by means of piercing tools having different characteristic dimensions in at least the direction of alignment of the raised elements. This enables tubes having dimensions which are different in at least the alignment direction to be accommodated in the said holes.

According to a preferred feature of the invention, each raised element is adapted to be pierced by press tools of different characteristic dimensions, in a direction at right angles to the alignment direction of the raised elements. This enables the tubes to be fitted in the resulting holes, the tubes having at least two different dimensions in the direction at right angles to the alignment direction.

In this way, a single press-forming tool enables the press-formed elements to be made in which the aligned raised elements enable holes of different cross sections or profiles to be formed in them. A single one of these raised elements will be enough to enable a hole of small dimensions to be made, while two consecutive aligned raised elements will for example enable a hole of larger size, or even two holes of smaller size, to be formed.

Preferably, at least one of the raised elements has a dimension in the alignment direction which is different to the dimension or dimensions of the other raised element or elements.

In a preferred embodiment of the invention, each press-formed element has three raised elements. These elements are aligned with each other and are adapted to be pierced, individually or in combination to enable tubes, having three different dimensions in the alignment direction and of five different dimensions in a direction at right angles to the alignment direction, to be accommodated.

In this way, starting from a standard workpiece in the form of a pressing, the workpiece is then press-formed using a single press-forming tool. The tool is capable of making, in a single operation, a plurality of press-formed elements parallel with each other, in which each of these press-formed elements comprises three raised elements aligned with each other. At least fifteen header plates can be made with the aid of perforating tools or punches of different profiles, the holes in these header plates being of different dimensions as between one header plate and another.

According to the invention in a second aspect, a method of making a header plate for a heat exchanger, especially for a motor vehicle, is characterised in that it comprises the following steps:

providing a workpiece including a flat central portion;

press-forming the central portion of the workpiece to give it a plurality of press-formed elements parallel to each other, with each press-formed element including at least two raised elements aligned with each other and having respective selected dimensions;

piercing at least one of the raised elements of each press-formed element individually or in combination, to form holes the dimensions of which are adapted to enable the ends of tubes, having different dimensions in at least the direction in which the raised elements are aligned, to pass through the holes.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 5:
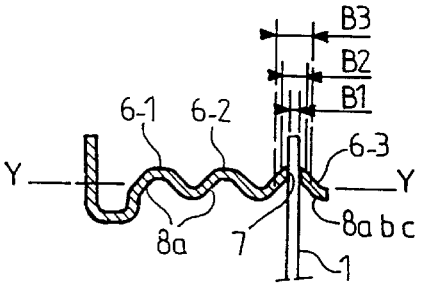
FIG. 5 is a view in transverse cross section taken on the line V—V in FIG. 1.

A heat exchanger generally includes either one or two fluid headers (not shown), into which the ends of metal tubes 1 (see FIG. 5) are open. The tubes 1 constitute a bundle of tubes which are spaced apart by cooling fins, not shown. The tubes 1 are maintained generally parallel to each other by means of a header plate 2 (or collector). The header consists of the header cover and the header plate, assembled together with the header plate covering the open side of the header cover.

Figure 1:
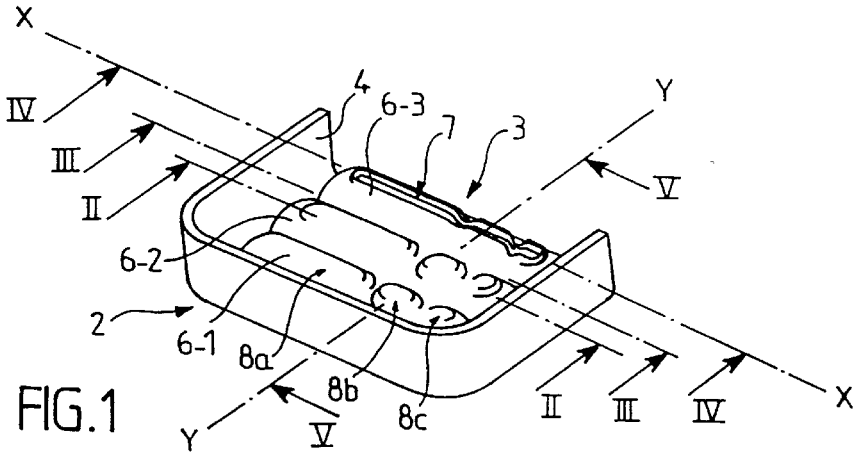
FIG. 1 is a perspective view of part of a header plate in accordance with the invention, in the above mentioned preferred embodiment of the invention.

The header plate 2 itself comprises, firstly, a central base portion 3, and secondly, extending over the whole of the periphery of the central base portion 3, a peripheral flange 4. The flange 4 is formed for example by bending, and it defines a U-shaped groove 5 which is arranged to contain a peripheral gripping element formed on the periphery of the wall of the header cover (not shown). In its central base portion, the header plate 2 has a multiplicity of press-formed elements or bosses 6. In general terms, the individual bosses 6 can be denoted as 6-i, where i=1 to n, n being the total number of these press-formed bosses. The bosses 6 are parallel to each other, and each one is formed with a through hole 7. In FIG. 1, only the hole 7 in the press-formed element 6-3 is shown. Each hole 7 is arranged to receive the corresponding end of a respective one of the tubes 1. The holes 7 are parallel to each other.

Figure 3:
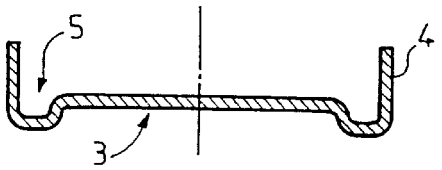
FIG. 3 is a view in transverse cross section taken on the line III—III in FIG. 1.

The press-formed elements 6 are preferably arranged to be fitted to tubes of oblong profile, also referred to as flat tubes, which define a width (or minor axis) B and a length (or major axis) A. The tubes are normally positioned in the header plate 2 parallel to the minor side or transverse side of the header plate. In consequence, in the remainder of this description, it will be taken that the length of a section of a tube 1 (or the corresponding length of the hole 7) corresponds to a direction which is substantially at right angles to the major or longitudinal side of the header plate 2; similarly, the width of a section of tube 1 (or hole 7) corresponds to a direction substantially at right angles to the minor or transverse side of the header plate 2. As can be seen in FIG. 3, the space between two consecutive press-formed elements 6 is flat.

Each press-formed element 6 is divided into at least two sections 8*a* and 8*b*. Each of these sections constitutes a raised element. In the example shown in the drawings, each of the press-formed elements 6-i is in fact divided into three of these raised elements 8*a* to 8*c*.

The press-formed elements 6 are formed as follows. A workpiece (shown in FIG. 3) is first formed, in which the peripheral flanges 4 surrounding the flat central portion 3 preferably have a configuration which defines the U-shaped groove 5. The central portion 3 of the workpiece is then reformed using a forming tool which has a multiplicity of die heads parallel to each other. Each of these die heads comprises the appropriate number of aligned portions for forming the required configuration on the base portion 3 of the workpiece, i.e. three in the example shown in the drawings. In this way, the central portion 3 of the workpiece is reformed so as to form the elements 6, with the number of raised elements or sections 8 in each press-formed element 6 then being the same as the number of the above mentioned portions of each working head of the press tool.

It will be clear that the number of sections or raised elements into which a press-formed element 6 is divided depends on the total number of tubes of different cross sections which are used by a manufacturer to form the various different versions of heat exchangers produced by that manufacturer. Accordingly, partly-formed header plates, or blanks, can be stocked in a standard form such as is shown in FIG. 3, and these can be converted by suitable press-forming or stamping into a large number of different designs of header plate 2 which are adapted to receive tubes of different cross sections from each other. For example, a first type of header plate 2 can be made, in which only the sections 8*a* are formed with a hole 7, having a length A1 (see FIG. 2) and a width B1 (see FIG. 5).

Figure 2:
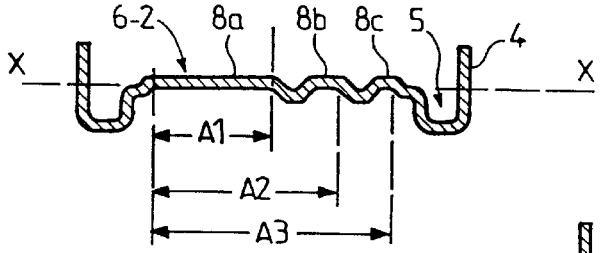
FIG. 2 is a transverse cross section taken on the line II—II in FIG. 1.
Figure 4:
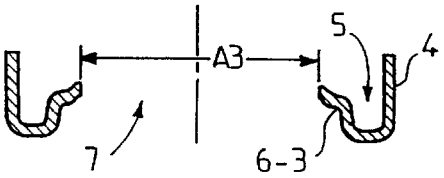
FIG. 4 is a view in transverse cross section taken on the line IV—IV in FIG. 1.

In the example shown in FIGS. 1 and 4, the hole in the press-formed element 6-3 extends over the whole length of the three sections 8*a* to 8*c*, or raised elements, so that the length of this hole is A3, as indicated in FIGS. 2 and 4. However, it is of course possible to provide numerous other versions of the header plate 2, as for example a first modified version in which the holes are formed in two consecutive raised elements 8*a* and 8*b*, so as to accommodate tubes of length A2 (see FIG. 2). In a second modified embodiment, two rows of holes, of lengths A1 and A4 respectively, are formed using the raised elements 8*a* and the combination of the consecutive raised elements 8*b* and 8*c*. In this last mentioned version, two tubes can be accommodated within the width of a header cover, and consequently within the width of a header plate 2, where these tubes are oblong tubes having either substantially equal dimensions (if A1=A4), or different dimensions (if A1≠A4). This for example enables heat exchangers to be made with only one header.

Just as the length of the holes 7 can be varied, it is also possible to vary the width of the holes 7. In this connection, the press-formed elements 6, and therefore the sections 8 of the latter, have a dimension in the direction Y-Y, at right angles to the direction of alignment X-X of the sections 8, which is sufficiently large to enable at least two different widths of holes to be formed. Preferably the holes 7 are large enough to enable holes of five different widths B to be made. In the example shown in FIG. 5, holes of only three different widths B1 to B3 are indicated.

Thus, using a full set of press tools with heads of different dimensions, it is possible, starting with a standard blank or pressing (as shown in FIG. 3 for example), to make a very large number of designs of header plates 2 which can be fitted to tubes of different cross sections. Not only does this enable a standard pressing to be easily made available for subsequent formation of the required configuration of press-formed elements and holes, ready for these operations to be carried out as required, but it also enables production costs of the header plates to be substantially reduced.

In addition it is also possible, if necessary, to adapt header plates having holes of a first cross section to header plates having holes of a second cross section, which is greater in length and/or width than the first section.

In order to make a header plate in accordance with the invention, it is necessary to carry out the following steps:

- a first step in which a standard pressing or workpiece is formed having a flat central portion 3;
- a second step in which the central portion 3 of the pressing is reformed using an appropriate tool, so that the central part includes a plurality of press-formed portions or bosses 6-i parallel to each other, with each of these press-formed portions 6 including at least two raised elements or sub-sections 8 aligned with each other and being of respective selected dimensions; and
- a third step in which at least one of the raised elements 8 of each boss 6 formed in the preceding step is punched, individually or in combination with at least one other element 6 and/or raised element 8, in such a way as to form the holes 7 with dimensions matched to those of the corresponding tubes 1.

Once the header plate has been made in this way, it is only necessary thereafter to introduce the tubes into the holes 7 and then to secure together, by brazing or welding, the outer wall of each tube and the header plate in the region of the perforated raised elements which defines the hole 7 corresponding to that tube.

The invention is not limited to the embodiment described above, but embraces all possible modifications that might be developed by the person in the art within the scope of the Claims appended hereto. Thus for example, the number of raised elements or sections of any one of the press-formed elements or bosses may be very much greater than two, and the width of the raised elements can be so adapted as to enable more than five different widths of holes to be formed.

What is claimed is:

1. A header plate pierced by tool elements having different dimensions for a motor vehicle heat exchanger which includes the header plate and a plurality of tubes with different dimensions, each of the tubes having ends fitted in the header plate, the header plate comprising a central portion defining at least one row of through holes therein for receiving the ends of the tubes, press-formed elements in said central portion, each of said press formed elements has at least two raised elements defining an alignment direction in which said raised elements are aligned with each other, said raised elements having respective predetermined dimensions, said raised elements being pierced individually and together by the tool elements having different dimensions in at least said alignment direction to provide holes in the header plate of different dimensions in said alignment direction and to enable the tubes, having different dimension in at least said alignment direction, to pass through said holes.

2. A header plate according to claim 1, wherein each said raised element is pierced by the piercing tools of different characteristic dimensions in a direction at right angles to said alignment direction to enable tubes having at least two different dimensions in the direction at right angles to said alignment direction to pass through said holes.

3. A header plate pierced by tool elements having different dimensions for a motor vehicle heat exchanger which includes the header plate and a plurality of tubes with different dimensions, each of the tubes having ends fitted in the header plate, the header plate comprising a central portion defining at least one row of through holes therein for receiving the ends of the tubes, press-formed elements in said central portion, each of said press-formed elements having at least two raised elements defining an alignment direction in which said raised elements are aligned with each other, said raised elements having respective predetermined dimensions, said raised elements being pierced individually and together by the tool elements having different dimensions in at least said alignment direction to enable the tubes, having different dimensions in at least said alignment direction to pass through said holes, wherein, in at least one said raised element, the dimension in the alignment direction is different from that of at least one other said raised element in the alignment direction.

4. A header plate according to claim 2, wherein each said press-formed element has three said raised elements aligned with each other, said raised elements being pierced individually and in combination, whereby to enable the tubes, having three different dimensions in said alignment direction and five different dimensions in a direction at right angles to said alignment direction, to pass into said holes.

5. A method of making a header plate for a motor vehicle heat exchanger, comprising the steps of:

providing a workpiece having a flat central portion;

press-forming said central portion to form a plurality of press-formed elements parallel to each other to define, in each said press-formed element, at least two raised elements aligned with each other in an alignment direction and having respective selected dimensions;

piercing at least one of said raised elements of each said press-formed element, whereby to form holes to enable the ends of tubes of different dimensions in at least said alignment direction to be passed through said holes.

6. A method according to claim 5, wherein, in the press-forming step, the respective dimensions of said raised elements are so selected that said holes having, in the direction at right angles to said alignment direction, a dimension which can assume at least two different values, can be formed.

* * * * *